US007244164B2

(12) United States Patent
Isenberg

(10) Patent No.: US 7,244,164 B2
(45) Date of Patent: Jul. 17, 2007

(54) TOY WITH CUSTOMIZATION FEATURE

(76) Inventor: Barbara L. Isenberg, 151 Central Park West, New York, NY (US) 10023

( * ) Notice: Subject to any disclaimer, the term of this patent is extended or adjusted under 35 U.S.C. 154(b) by 0 days.

(21) Appl. No.: 10/699,080

(22) Filed: Oct. 31, 2003

(65) Prior Publication Data

US 2004/0116041 A1 Jun. 17, 2004

Related U.S. Application Data

(63) Continuation-in-part of application No. 10/425,182, filed on Apr. 29, 2003, now abandoned.

(60) Provisional application No. 60/376,298, filed on Apr. 29, 2002.

(51) Int. Cl.
*A63A 33/26* (2006.01)

(52) U.S. Cl. ..... 446/132; 446/139; 446/361; 446/364; 273/108.51; 273/443

(58) Field of Classification Search ..... 446/75, 446/101, 97–99, 137, 139, 361, 364, 366, 446/474, 491, 133, 135; 434/236, 237, 258–260, 434/393; 273/108.51, 126 A, 443
See application file for complete search history.

(56) References Cited

U.S. PATENT DOCUMENTS 1,551,050 A * 8/1925 Parsons ..... 446/139
1,608,353 A * 11/1926 Zaikine ..... 472/12
2,036,076 A * 3/1936 Philippl ..... 446/135
2,213,901 A * 9/1940 Crawford ..... 446/139
2,637,138 A * 5/1953 Doran et al. ..... 446/83
2,663,967 A * 12/1953 Mathis ..... 446/135
2,767,517 A * 9/1956 Hooper ..... 414/335
2,814,909 A * 12/1957 Knowles ..... 446/135
3,091,459 A * 5/1963 Lindman ..... 273/108.4
3,462,873 A * 8/1969 Moreci ..... 446/135
3,583,702 A * 6/1971 Glass et al. ..... 273/443
3,699,703 A * 10/1972 Biecker ..... 446/83
3,888,233 A * 6/1975 Ware ..... 660/28
3,946,520 A * 3/1976 Goldfarb et al. ..... 446/135
4,233,778 A * 11/1980 Lemelson ..... 446/92
4,356,658 A * 11/1982 Goldfarb ..... 446/83
4,834,371 A * 5/1989 Hay et al. ..... 273/108.51
4,971,313 A * 11/1990 Hucks ..... 472/81
5,318,469 A * 6/1994 Unalp et al. ..... 446/73
5,885,128 A * 3/1999 Blaustein et al. ..... 446/369
6,494,763 B1 * 12/2002 Hastey ..... 446/376
6,565,407 B1 * 5/2003 Woolington et al. ..... 446/175

FOREIGN PATENT DOCUMENTS

WO WO 9850126 A1 * 11/1998

* cited by examiner

*Primary Examiner*—Bena Miller
(74) *Attorney, Agent, or Firm*—St. Onge Steward Johnston & Reens LLC

(57) ABSTRACT

A toy is provided comprising a figure with a hole disposed therein and having at least one ferrous portion; a manipulator having a magnet for interacting with the at least one ferrous portion to animate the figure; and a stage for receiving the figure on one side thereof and for receiving the manipulator in the other side thereof, for animating the figure.

10 Claims, 5 Drawing Sheets

TOY WITH CUSTOMIZATION FEATURE

PRIOR APPLICATION

This application is a continuation-in-part of U.S. patent application Ser. No. 10/425,182 filed Apr. 29, 2003, which application is now abandoned, and which claims priority to U.S. Provisional Patent Application No. 60/376,298, filed Apr. 29, 2002.

FIELD OF THE INVENTION

The present invention relates to a toy that is customized with accessories. The present invention relates to a toy with a dressing and/or animation feature.

BACKGROUND OF THE INVENTION

Dressable toys are known. Such toys include figures of real or imaginary people, animals, characters or other beings. These toys include dolls, stuffed animals and paper-dolls. Bears are particularly popular plush figures and are often dressed to simulate real or imaginary people, animals, characters or other beings. Typically, clothing includes snaps or buckles and accessories are added to the figure using elastic bands.

The demand for more sophisticated toys grows, and there exists a need to develop better methods of attaching clothing and other accessories to toys. There exists a need to provide more appealing and sophisticated toys that serve as learning tools and aid in the development of hand-eye coordination in children.

SUMMARY OF THE INVENTION

The present invention relates to a toy comprising a figure with a hole in a portion thereof for receiving an accessory, the figure having at least one ferrous portion; a manipulator having a magnet for interacting with the at least one ferrous portion of the figure to animate the figure; and a stage for receiving the figure on one side thereof and for receiving the manipulator on another side thereof for animating the figure.

DETAILED DESCRIPTION OF THE DRAWINGS

The present invention provides several new techniques for customizing figures with accessories and for animating or moving figures. Using whimsical and attractive figures to teach children how to dress by associating accessories, including clothing, with relative parts of a body is an effective way to stimulate development in young children. Sophisticated attachment means allowing children to repeatedly dress and undress a figure, and features allowing children to move and animate the figure both serve to improve hand-eye coordination in children. Further, plush figures are very appealing and soothing to children who may cuddle the plush figure.

The range of items used to customize toys includes reproductions of things such as sports equipment and other gear used to pursue the vocation or avocation for which the figure is being "dressed." Examples include an easel and palette for a painter teddy bear, a backpack and boots for a hiking teddy bear, a messenger bag and calculator for a student teddy bear, and so on. Thus, the toy may be customized for the owner or recipient.

Figures may be modified in shape and/or by the addition of features to their interior or exterior fabric which facilitate the attachment of accessories to customize the toy and which facilitate movement and animation of the toy by the child. Specifically, modification to various body parts or surfaces of the figure allow for customization.

The term "figure" as used herein means any real or imaginary being, person, or animal. Figure may be filled with stuffing, having an outer surface made of plush fabric, leather, vinyl or other appropriate material for a stuffed figure, such as a doll, teddy bear or the like.

Figure 1:
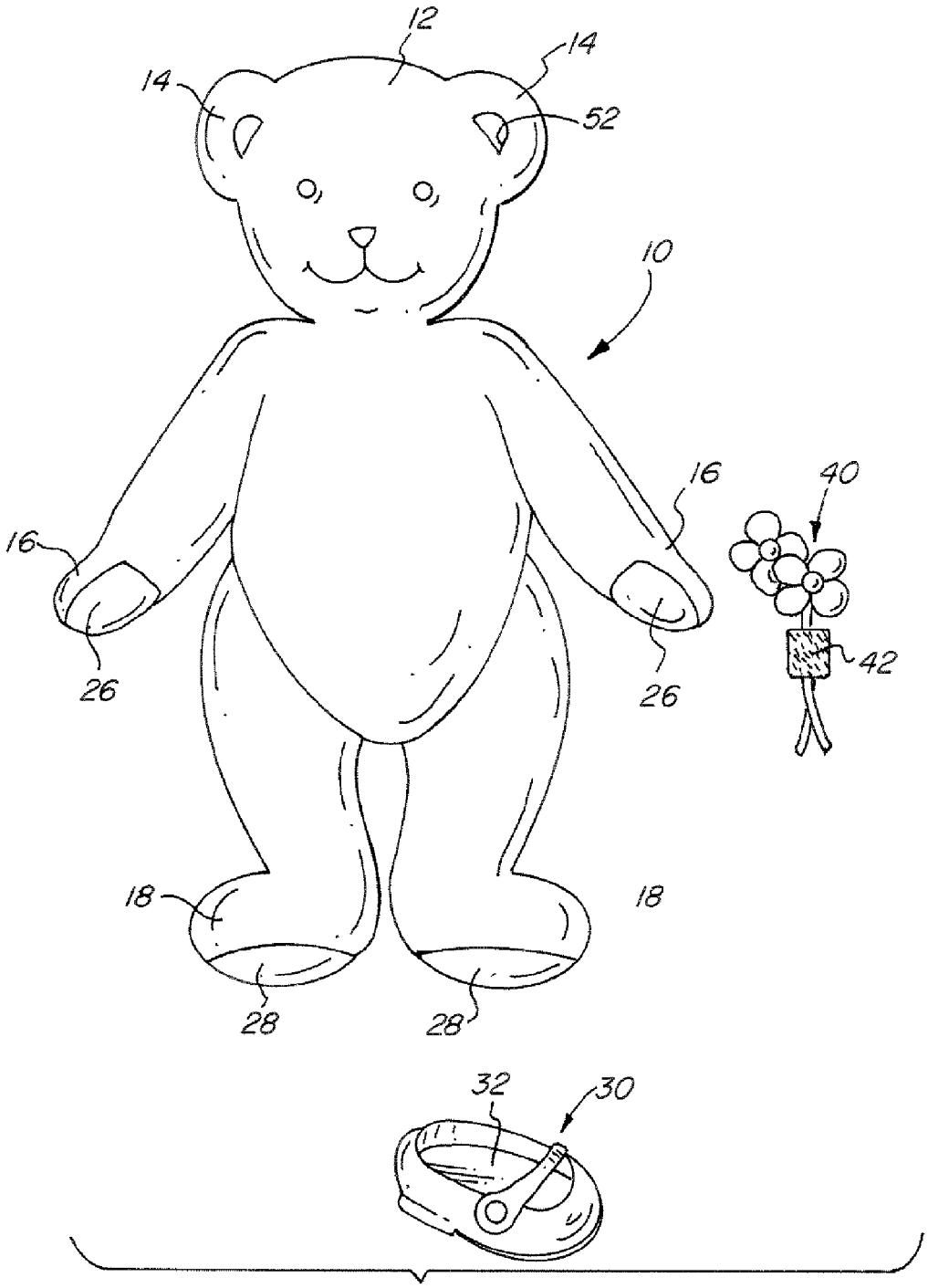
FIG. 1 is frontal view of an embodiment of the present invention.

FIG. 1 shows generally a figure 10 in the form of a plush stuffed bear including body parts such as head 12, ears 14, hands or "front paws" 16, and feet or "back paws" 18. Front paws 16 may have front paw pads 26, and back paws 18 may have back paw pads 28.

Various accessories may be configured to be received by the various body parts of figure 10. Shown in FIG. 1, accessory 40 is in unattached position. In this embodiment, accessory 40 is a bunch of flowers and configured to be received by paw 16. Accessory 40 includes attachment surface 42. Front paw pads 26 is modified to provide a surface for receiving attachment surface 42 so that the plush figure 10 receives accessory 40. These surfaces 26, 42 act together to achieve attachment of accessory 40 to figure 10. This may be accomplished by a hook and loop fastener, a snap, or like, with respective portions placed on each surface which act together to put accessory 40 in attached position. Alternatively, portions of surface fabric of the figure may be slightly modified in particular areas as to be hook and loop fastener-friendly, and enable the surface fabric of the figure to grasp or receive particular types of accessories as described herein.

The attachment means may vary in difficulty and be customized to the age of the child and their stage of development in term of small motor skills. Similarly, back paw pads 28 provide a desired surface to receive an item of clothing, specifically a shoe 30, in the embodiment shown in FIG. 1. The inner sole of the shoe has an attachment surface 32 to be matched to a relative surface on the back paw pad 28 of the plush figure. In attached position, back paw 18 receives shoe 30.

The present invention requires children to discern which body part of figure appropriately receives each accessory, teaching them how to dress the figure and likewise themselves. The present invention provides an appealing learning tool for children. Additionally, the present invention requires that children manipulate their hands and fingers to attach accessories and animate or move the figure. The ability to control and coordinate the small muscles of the wrist, hand and fingers aids in the development of small motor skills and hand-eye coordination in children. The appeal of a decorative, customized plush toy makes dressing process interesting and the work required to dress or animate the plush toy desirable and fulfilling to children. Dressing the figure challenges children while also facilitating the activity by providing sophisticated and easy-to-us attachment means, such as a hook and loop fastener.

The figure itself may be modified, such as in shape, to facilitate dressing in several ways. Firstly, accessories such as jewelry, ribbons, or other material can be threaded or passed through holes in various body parts of the figure to achieve attachment to the desired body part and dressing of the plush figure. For example, a hole or aperture in the ear of the bear facilitates attachment of hair ornaments and jewelry. This is particularly useful for attaching headgear, such as a bow or a tiara. The surface of the figure may be modified in texture, such as a fabric that will catch and stick to hook and loop fastener, or by the addition of attachment means, such as snaps, buttons, hook and loop fastener.

The figure may contain wiring, hinging or other suitable material allowing at least portions of figure to be bent, posed, or otherwise moved, and further providing a means to receive an accessory. For instance, the arm of the figure may be bent at its elbow, so as to be able to receive and hold in place a purse or bag.

The figure may contain ferrous portions allowing at least portions of the figure to interact with a magnet or magnetic accessory manipulated by the child to move, animate or dress the figure.

Figure 2:
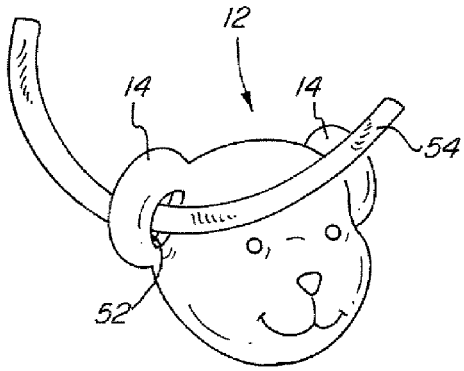
FIG. 2 is a partial perspective view of the embodiment shown in FIG. 1.
Figure 3:
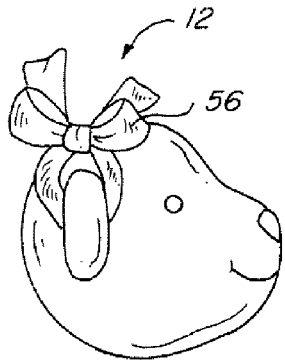
FIG. 3 is a partial side view of the embodiment shown in FIG. 1.

FIG. 2 shows generally head 12 of plush figure 10 shown in FIG. 1, including ears 14 and ear hole 52. Ear hole 52 can be used to attach accessories in several ways. An item of clothing or an accessory may be threaded directly though the ear hole 52 for attachment to the plush figure. As shown in FIG. 2, accessory 54 is a ribbon which is drawn through hole 52. FIG. 3 is a side view of head 12 in which accessory 54 is in attached position as the ribbon 54 has been tied into bow 56.

Figure 4:
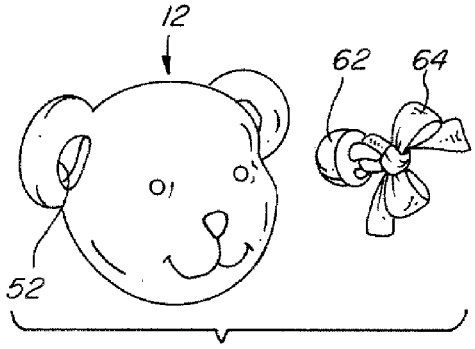
FIG. 4 is partial perspective view of the embodiment shown in FIG. 1
Figure 5:
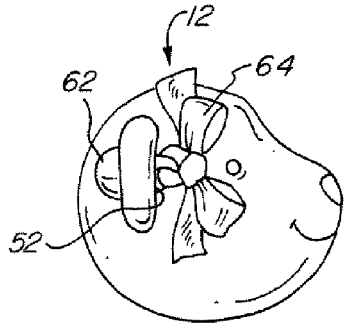
FIG. 5 is a side view of the embodiment shown in FIG. 1.

Secondly, accessories may include attachment means such as bands, ribbons, or straps, to be passed through an aperture in a body part of the plush figure, such as ear hole 52, to achieve attachment of accessory in the appropriate area. Thirdly, accessories may include buttons that can be passed through holes in the plush figure to attach accessories. FIG. 4 shows generally head 12, with ear 14 and ear hole 52. Ear hole 52 is configured to receive accessory, specifically bow 64, shown in unattached position. Button 62 to which bow 64 has been tied or otherwise attached, facilitates attachment of bow 64 to ear hole 52 of plush toy. FIG. 5 shows ear hole 52 having received button 62 so as to place bow 64 in attached position.

Accessories may include clothing, shoes, hats, jewelry, sports uniforms and equipment, and other apparel and objects related to particular themes, athletics, hobbies, occupations, or other pastimes. Accessories may include objects which relate to a particular vocation, avocation, or theme for which the plush toy is being dressed or customized. Accessories may include jewelry such as earrings, necklaces and the like, headwear such as hats, visors, tiaras, barrettes, bows, ribbons, and the like, purses, backpacks, sports equipment such a tennis racquet, and other whimsical handheld items such as wands and flower bouquets.

The accessories may relate to any common theme. One example is a beach theme, which may include a swimsuit, sunglasses, a beach pail and shovel. Another example is a baseball theme, which may include a baseball uniform, cleats, ball, glove, and cap. Another example is a princess theme, which may include a dress, wand and tiara.

Figure 6:
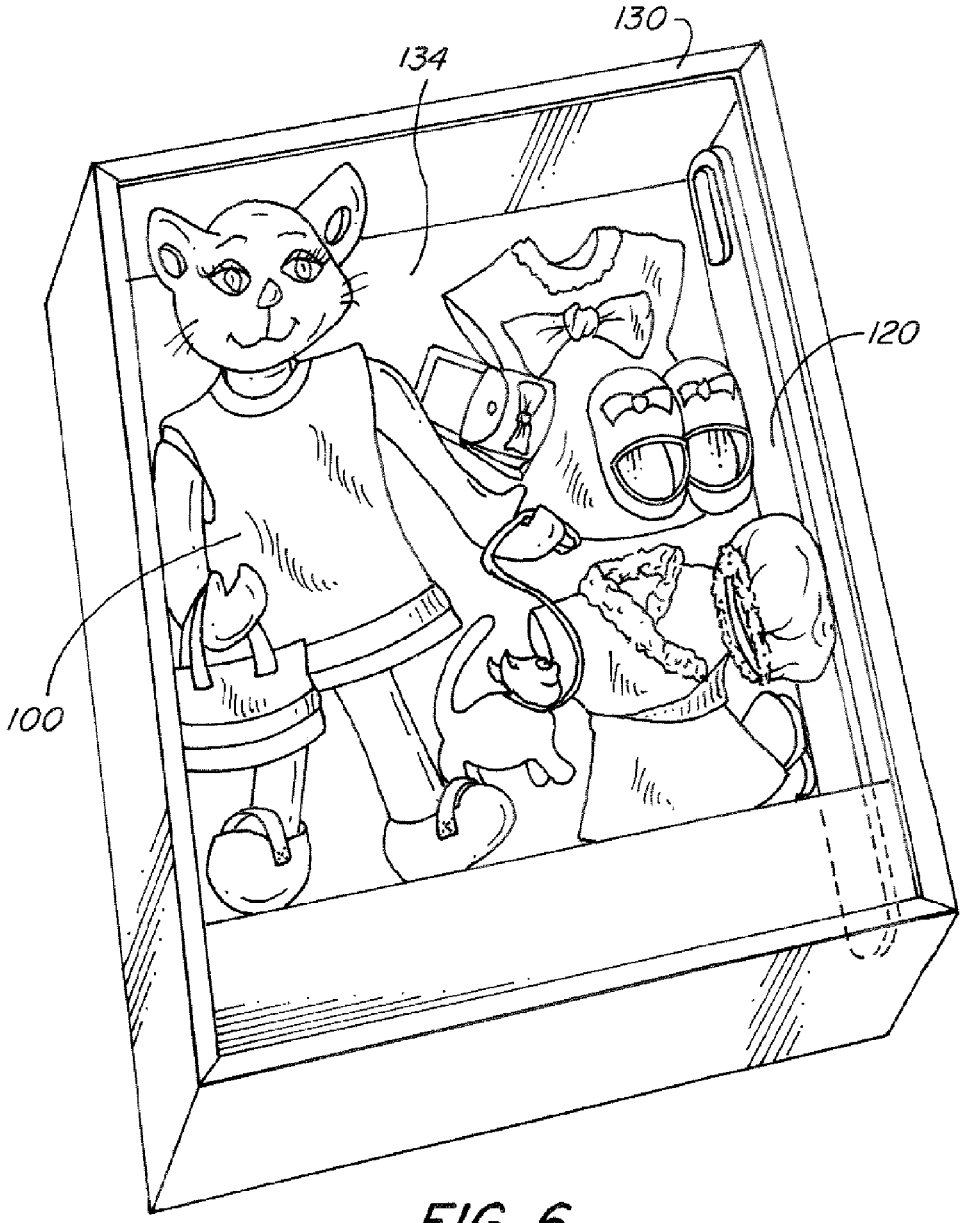
FIG. 6 is a perspective view of an embodiment of the present invention shown in FIGS. 1–5, incorporating additional features.
Figure 7:
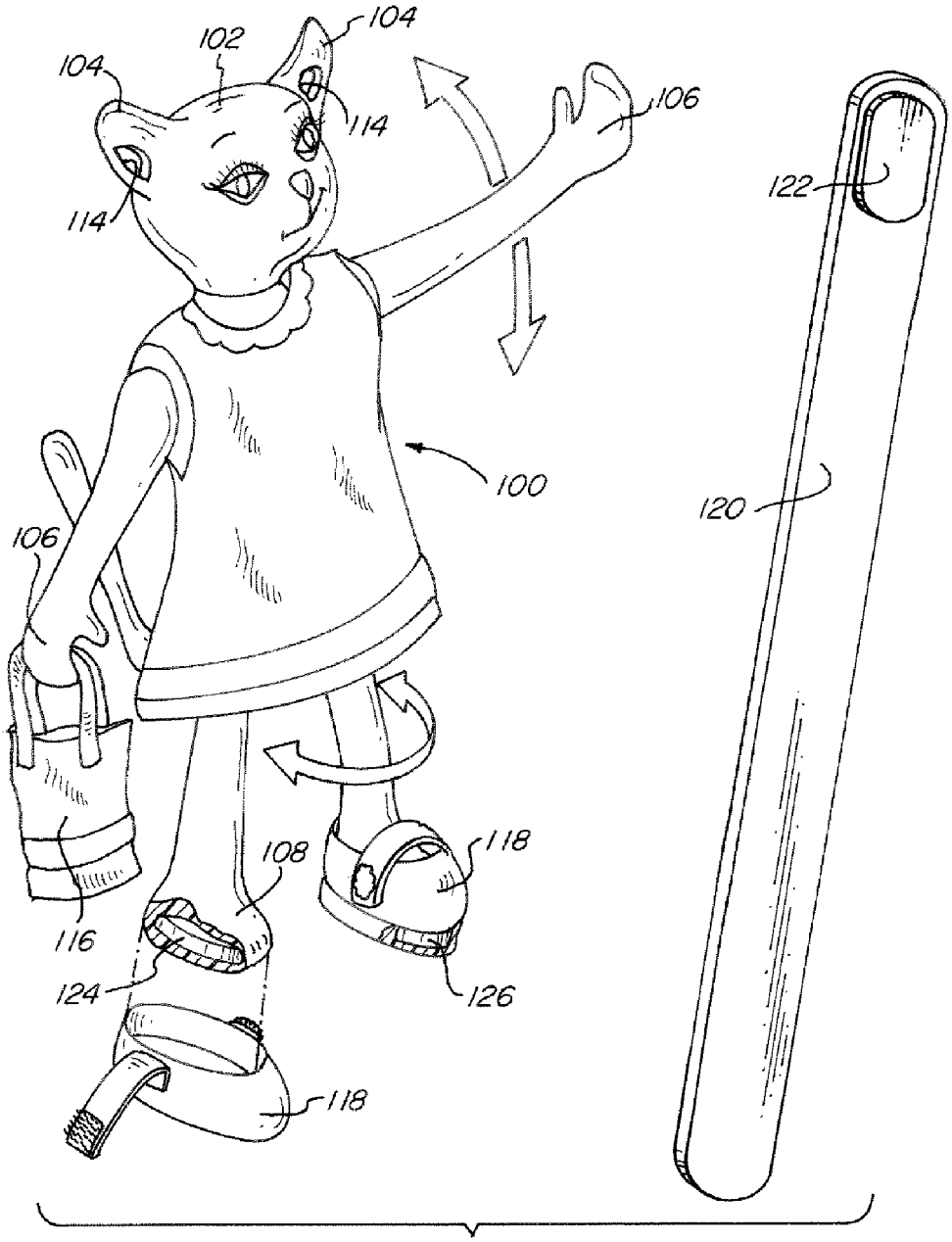
FIG. 7 is a perspective view of the figure and manipulator of the embodiment shown in FIG. 6.

FIG. 6 shows an embodiment of the present invention shown in FIGS. 1–5, incorporating additional features, including FIG. 100, manipulator 120, and stage 130 in which FIG.100, manipulator 120, and various accessories may be stored within bottom surface 134 of stage 130. In this respect, stage 130 is additionally acting as a box or container. FIG. 100 is shown as a plush stuffed animal, specifically a cat, but may take the form of other stuffed beings, such as people, animals, or imaginary characters. Referring to FIG. 7, FIG. 100 has body parts including head 102, ears 104, hands 106, and feet 108. FIG. 100 includes wiring, hinging or other suitable material within so as to make FIG. 100 and its limbs and body parts bendable, posable, and/or able to rotate.

The figure itself may be modified, such as in shape, to facilitate dressing in several ways. For example, accessories may be threaded or passed through holes in various body parts of the figure to achieve attachment to the desired body part and dressing of the plush figure. The surface of the figure may be modified in texture, such as a fabric that will catch and stick to hook and loop fastener, or by the addition of attachment means, such as snaps, buttons, hook and loop fastener.

Accessories shown include dress 110, handbag 116, shoes 118. Manipulator 120 includes magnet 122 disposed in at least one end thereof. FIG. 110 may include hole 114 disposed in at least one ear 104, or elsewhere, for attachment of accessories.

FIG. 100 has at least one ferrous portion 124, 126 disposed therein. Ferrous portion 124 is shown disposed in at least one foot 108 of FIG. 100. Ferrous portion 126 is shown disposed in at least one shoe 108 of FIG. 100 where shoe 108 may be permanently affixed or removably attached to foot 108. Various portions and body parts of FIG. 100, such as hands, legs, head, and the like, may have ferrous material or may receive accessories including ferrous portions in order to achieve animation of that body part or of the figure through that body part by the manipulator 120, as will be discussed below. Additionally, ferrous portions of FIG. 100 may serve as an attachment means for magnetic accessories.

Figure 8:
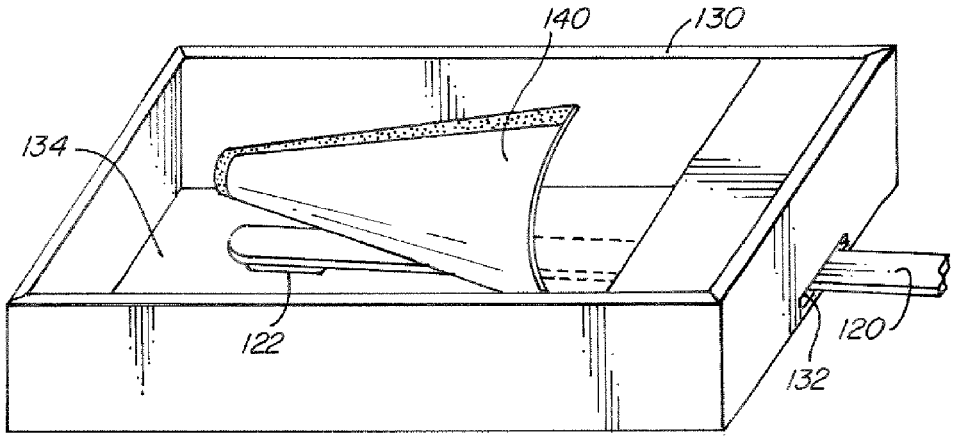
FIG. 8 is a rear perspective view the stage of the embodiment shown in FIG. 6.
Figure 9:
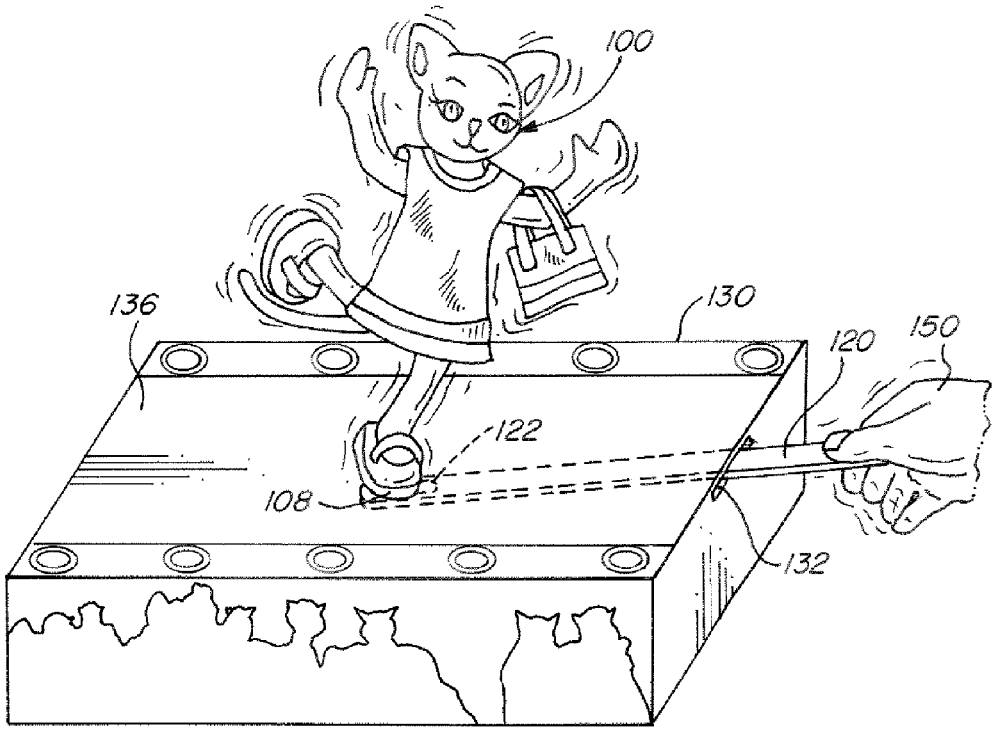
FIG. 9 is a perspective view of the embodiment shown in FIG. 6.

FIGS. 8-9 show how animation is achieved. FIG. 8 shows the bottom of stage 130 including slot 132 disposed therein to receive manipulator 120. Stage 130 has bottom surface 134 and may include backing 140 which may be adhered to the bottom surface 134 of stage 130 to retain manipulator 120 flatly against bottom surface 134 of stage 130. FIG. 9 shows the top of stage 130 including animation surface 136 which serves as a runway for FIG. 100. Manipulator 120 received in slot 132 is held and moved by hand 150. Magnet 122 disposed in end of manipulator 120 is held adjacent to the front surface 134 of stage 130 by hand 150 and additionally by backing 140, if desired. Magnet 120 interacts with ferrous portion of FIG. 100. In FIG. 9, ferrous portion may be disposed in either shoe 118 or foot 108 of figure 118. Foot 108 including shoe 118, is rested upon animation surface 136 of stage 130 and interacts with magnet 120 in manipulator 130. As hand 150 moves manipulator 130, FIG.

100 is caused to move along, twirl upon, or otherwise move about the runway, and, hence, is animated.

What is claimed is:

1. A toy comprising, a plush doll having at least one ferrous portion;

a manipulator having a magnet for interacting with said at least one ferrous portion of said doll to animate said doll;

a stage for receiving said doll on one side thereof and for receiving said manipulator on another side thereof, for animating said doll;

a backing disposed on said side of said stage that receives said manipulator to retain said manipulator on said side of said stage; and at least one accessory to be removably received by said doll, wherein said accessory is shoes removably attached to said doll at its feet and wherein said ferrous portion is permanently embedded completely within an interior part of-at least one of said shoes.

2. The toy of claim 1, wherein said doll is bendable and poseable.

3. The toy of claim 1, wherein said doll is a stuffed plush animal.

4. The toy of claim 3, wherein said stuffed plush animal is a cat.

5. The toy of claim 1, wherein said toy further comprises a second accessory to be removably received by said doll.

6. The toy of claim 5, wherein said doll has a hole passing completely through a part thereof for removably receiving said second accessory completely through the hole.

7. The toy of claim 6, wherein said hole passes completely through at least one ear of said doll.

8. The toy of claim 1, further comprising multiplicity of accessories related to a common theme.

9. The toy of claim 1, wherein said stage is a box for storing said doll and said manipulator.

10. The toy of claim 1, wherein said stage is a box for storing said doll, said manipulator, and said at least one accessory.

* * * * *